US005255621A

United States Patent [19]

Schramayr et al.

[11] Patent Number: 5,255,621

[45] Date of Patent: Oct. 26, 1993

[54] TURRET POCKET SETTER FOR TUBULAR FABRICS

[75] Inventors: Ernst Schramayr, Barnefeld; Tadeusz Olewicz, West Clinton, both of N.Y.

[73] Assignee: Westpoint Pepperell Inc., West Point, Ga.

[21] Appl. No.: 903,596

[22] Filed: Jun. 24, 1992

[51] Int. Cl.[5] ..... D05B 21/00

[52] U.S. Cl. ..... 112/121.12; 112/121.29; 112/141; 112/262.2; 112/262.3; 112/265.1

[58] Field of Search ..... 112/121.12, 121.15, 112/121.11, 121.29, 2, 104, 141, 147, 262.3, 265.1, 155, 262.2; 223/38

[56] References Cited

U.S. PATENT DOCUMENTS

| | | | |
|---|---|---|---|
| 3,152,736 | 10/1964 | Goldberg | 223/38 |
| 3,670,675 | 6/1972 | Rovin et al. | 112/121.12 |
| 4,493,276 | 1/1985 | Sadeh | 112/121.12 |
| 4,756,261 | 7/1988 | Gershoni | 112/121.12 |
| 4,784,070 | 11/1988 | Thurner et al. | 112/121.12 |
| 4,996,931 | 3/1991 | Mall | 112/121.12 |
| 5,003,897 | 4/1991 | Yokoe et al. | 112/121.12 |

*Primary Examiner*—Peter Nerbun

*Attorney, Agent, or Firm*—Schweitzer Cornman & Gross

[57] ABSTRACT

A method and apparatus is disclosed for low cost, high production setting of pockets on tubular shirt bodies. An indexable turret apparatus is provided forming a plurality of radially extending work platforms arranged successively to receive and support loosely draped tubular shirt bodies and to support and position pocket plies thereover. At successive index positions, the pocket plies are folded and clamped on the front of the shirt bodies, then sewn to the shirts in the desired manner, and then removed and draped over a stacking bar, for eventual further processing. A single operator, working at the load station, places the shirt bodies and pocket parts in position, after which successive indexings of the equipment cause the necessary production operations to take place. Although each work platform contains several mechanisms, which are selectively actuated at different index positions, the operating devices for these are mounted on the fixed central turret structure, minimizing the number of actuating devices employed and avoiding the need for slip rings, rotary fluid couplings and the like.

19 Claims, 8 Drawing Sheets

FIG. 10
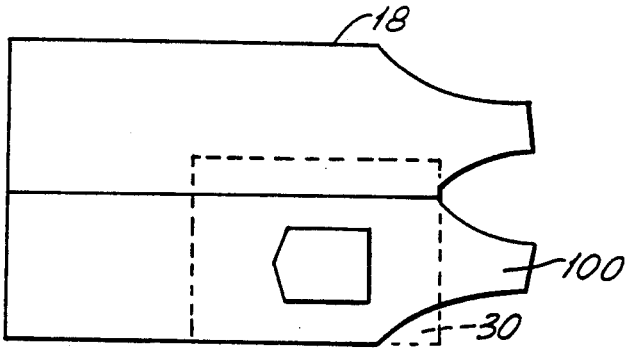
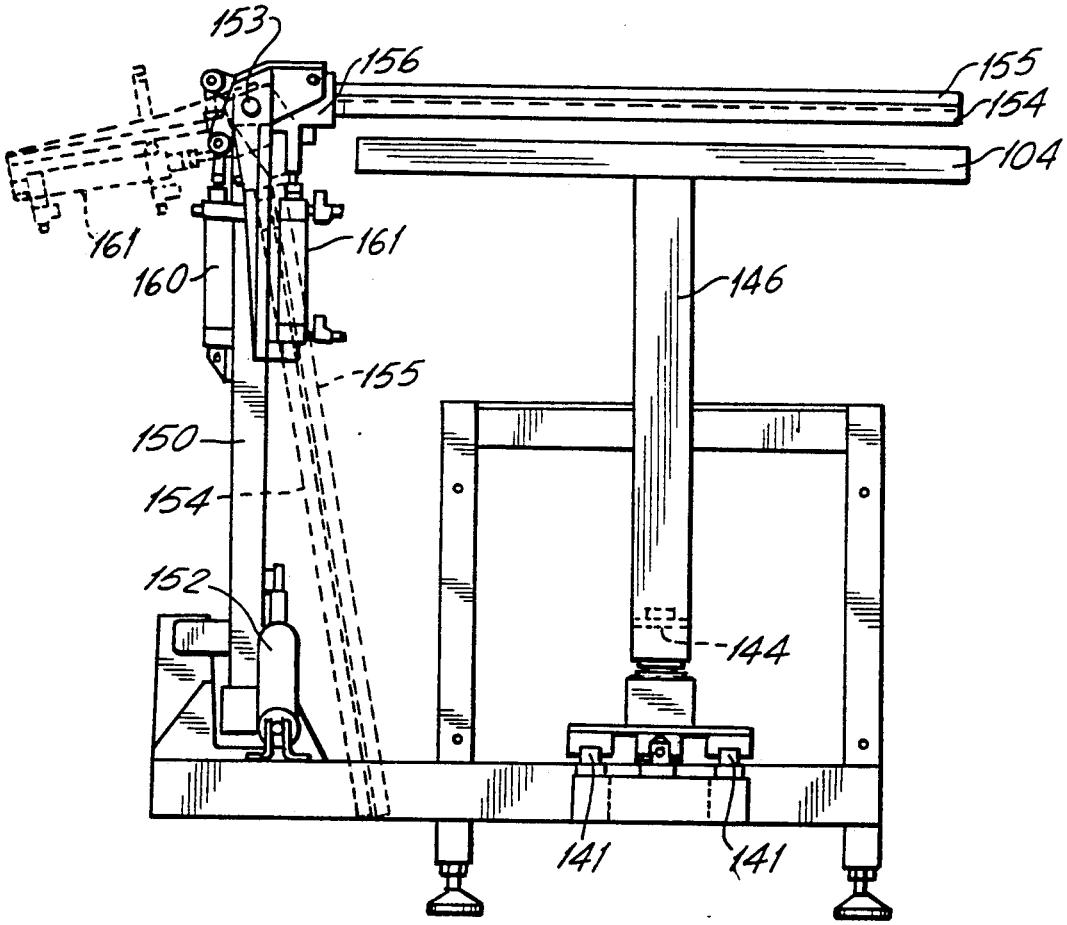
FIG. 7

TURRET POCKET SETTER FOR TUBULAR FABRICS

BACKGROUND AND SUMMARY OF THE INVENTION

The present invention is directed to equipment and procedures for setting pockets on the front of tubular shirt bodies, especially shirt bodies of tubular knitted construction.

The setting of pockets on tubular knitted shirt bodies historically has been a labor intensive operation, which has been resistance to previous efforts to fully automate. In general, the pocket setting operation involves bringing together a precut shirt body with a precut pocket ply, folding the margins of the pocket ply to provide hems, placing the folded ply at the proper location on the front of the shirt body, and while holding the folded ply in position sewing it along the side and bottom edges. Although the individual operations of folding the pocket ply in advance of sewing, and of sewing the folded ply to the shirt body, are in themselves well known, it has proven difficult to provide reliable and economical machinery for repetitively performing the necessary pocket setting operations with a minimum of operating personnel.

The Rovin U.S. Pat. No. 3,670,675 discloses an early effort to automate pocket setting operations, albeit not for tubular shirt bodies. The equipment disclosed in the Rovin et al. patent is not only complex and costly, but also occupies a great deal of factory floor space, limiting its suitability for many commercial garment manufacturing operations. Moreover, it is not suitable for setting pockets on tubular garments.

In accordance with the present invention, a system is provided which incorporates a plurality (preferably four) of activity stations radially arrayed about a central axis. The successive activity positions include a loading position in which tubular shirt bodies and pocket plies are manually positioned by a machine operator, a folding position in which the pocket ply is folded to form hems and then clamped against the front of the shirt body, a sewing position in which the folded pocket ply is secured to the shirt body, and a stacking position, in which the processed parts are removed and stacked for further processing in other areas.

To particular advantage, in the system of the invention, a rotatable, indexing platform is provided having a working position for each of the activity stations mentioned above. In any rotationally indexed position of the turret, the working positions of the turret platform align with the respective activity positions, so that actions are performed in sequence as the turret platform is successively indexed about its axis. In order to simplify the equipment and minimize floor space requirements, all of the power functions of the indexable turret mechanism are mounted on a central pillar and do not rotate during indexing movements. Instead, the mechanisms of the several movable work positions of the turret are brought successively into alignment with each of the index positions, at which one or more stationary power devices is available for actuating the particular devices or mechanisms to be employed at the particular activity position. The use of electrical slip ring systems and/or rotary fluid coupling devices is made unnecessary.

Using the procedure and apparatus of the invention, a single machine attendant can easily operate a four-station turret machine, to enable pocket setting operations to be carried out on tubular shirt bodies in a highly efficient and economical manner.

For a more complete understanding of the above and other features and advantages of the invention, reference should be made to the following detailed description of a preferred embodiment and to the accompanying drawings.

DESCRIPTION OF THE DRAWINGS

FIG. 7 is an end elevational view of a stacker advantageously employed in connection with the apparatus of the invention.

FIG. 10 is a highly simplified schematic representation showing a tubular shirt body in semi-developed, flat form, in relation to a support platform on which the body is placed for the necessary pocket setting operations.

DESCRIPTION OF A PREFERRED EMBODIMENT

Figure 1:
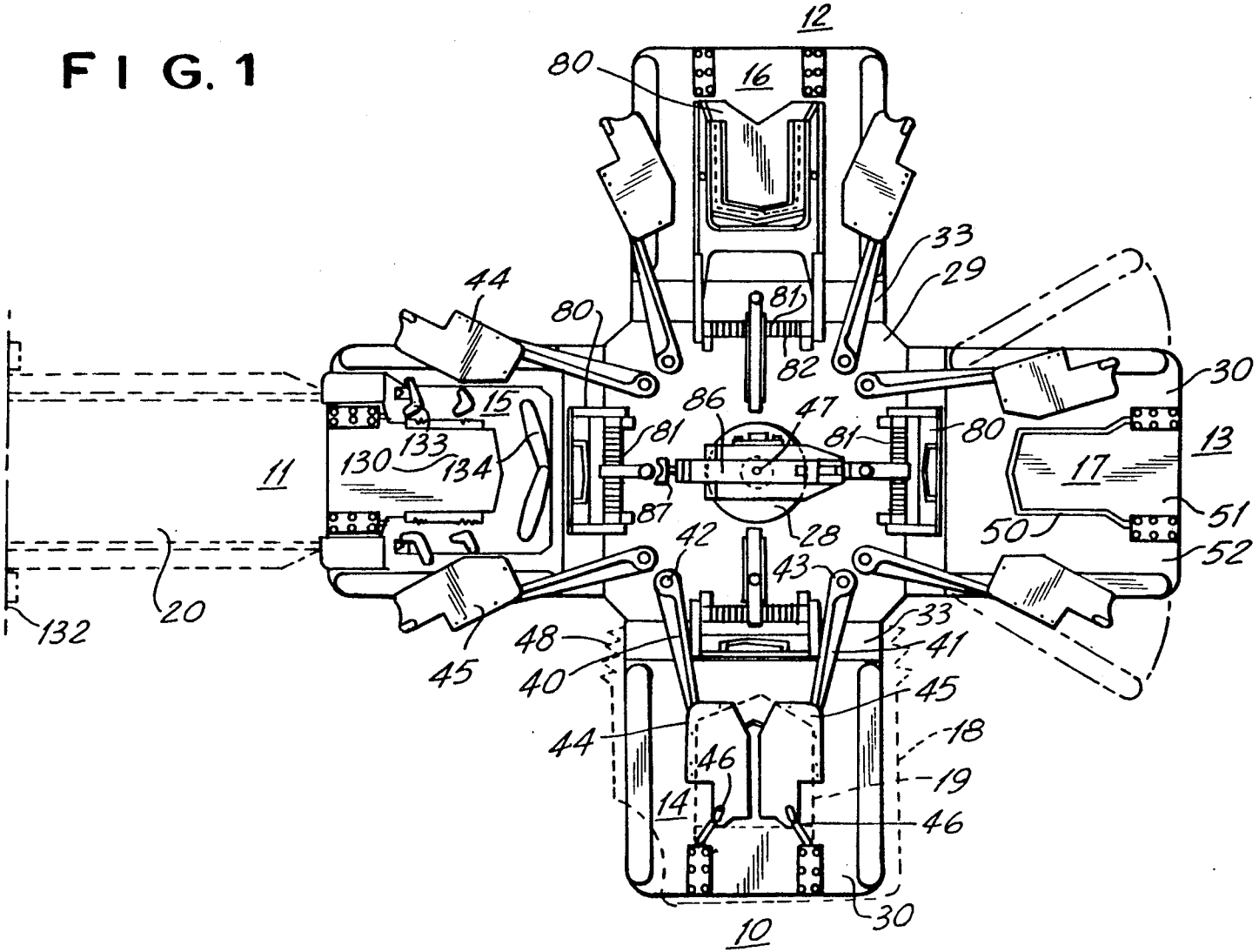
FIG. 1 is a simplified top plan view of a four-station turret apparatus according to the invention for the setting of pockets on tubular shirt bodies, particularly of tubular knitted material.

Referring now to the drawings, and initially to FIG. 1 thereof, there is shown a four-station turret apparatus for performing successive operations required to position, fold and sew a pocket to a tubular shirt body. The apparatus includes four external activity stations designated generally by the numerals 10–13. The equipment also includes an indexable turret apparatus having four work positions, designated generally by the reference numerals 14–17. At the first external activity station, a machine operator loads the apparatus by positioning thereon a tubular knitted shirt body, indicated at 18, and a pocket ply, indicated at 19. These tasks will be described in more detail hereinafter. After loading of the parts at load station 10, the turret apparatus is indexed one position or 90° in a clockwise direction, so that the work position 14 will move to the activity station 11 and so on.

At the activity station 11, a folding mechanism, generally indicated by the numeral 20 is actuated to underfold the side and bottom margins of the pocket ply to form hems, and the folded ply is pressed downward against the front face of the tubular shirt body 18. While this folding operation is taking place at activity station 11, the machine operator is performing another load operation at station 10. The turret apparatus then indexes 90° clockwise, advancing the folded and clamped pocket ply to the activity station 12, at which sewing is performed. A suitable sewing apparatus 21 (FIG. 3) is actuated through a predefined path, and operates to sew the hemmed side and bottom edges of the pocket ply to the shirt front. While the sewing activity is underway, a new folding operation is taking place at the folding station 11 and the operator is loading a new set of parts at the load station 10.

When the foregoing activities have been completed, the turret apparatus indexes a further 90° to bring the now-sewn pocket into a stacking activity station 13, at which it is engaged by an automatic stacking apparatus 22 (FIG. 8) and removed from the turret apparatus.

After the first cycle of operations, after each indexing of the turret apparatus, loading, folding, sewing, and stacking operations are taking place simultaneously at the respective activity stations 10–13, on a continuous basis.

Figure 2:
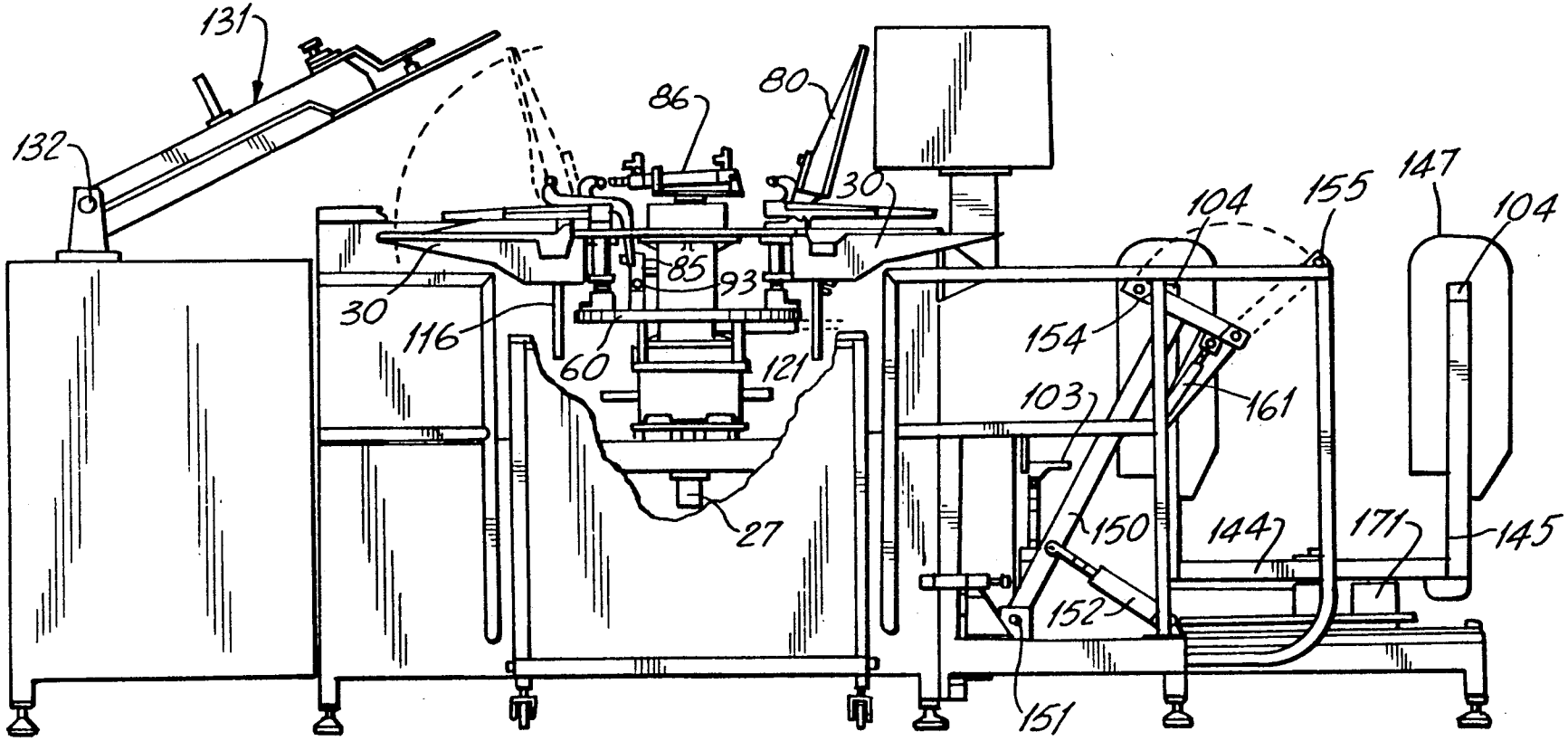
FIG. 2 is a front elevational view of the apparatus of FIG. 1, with parts broken away.
Figure 3:
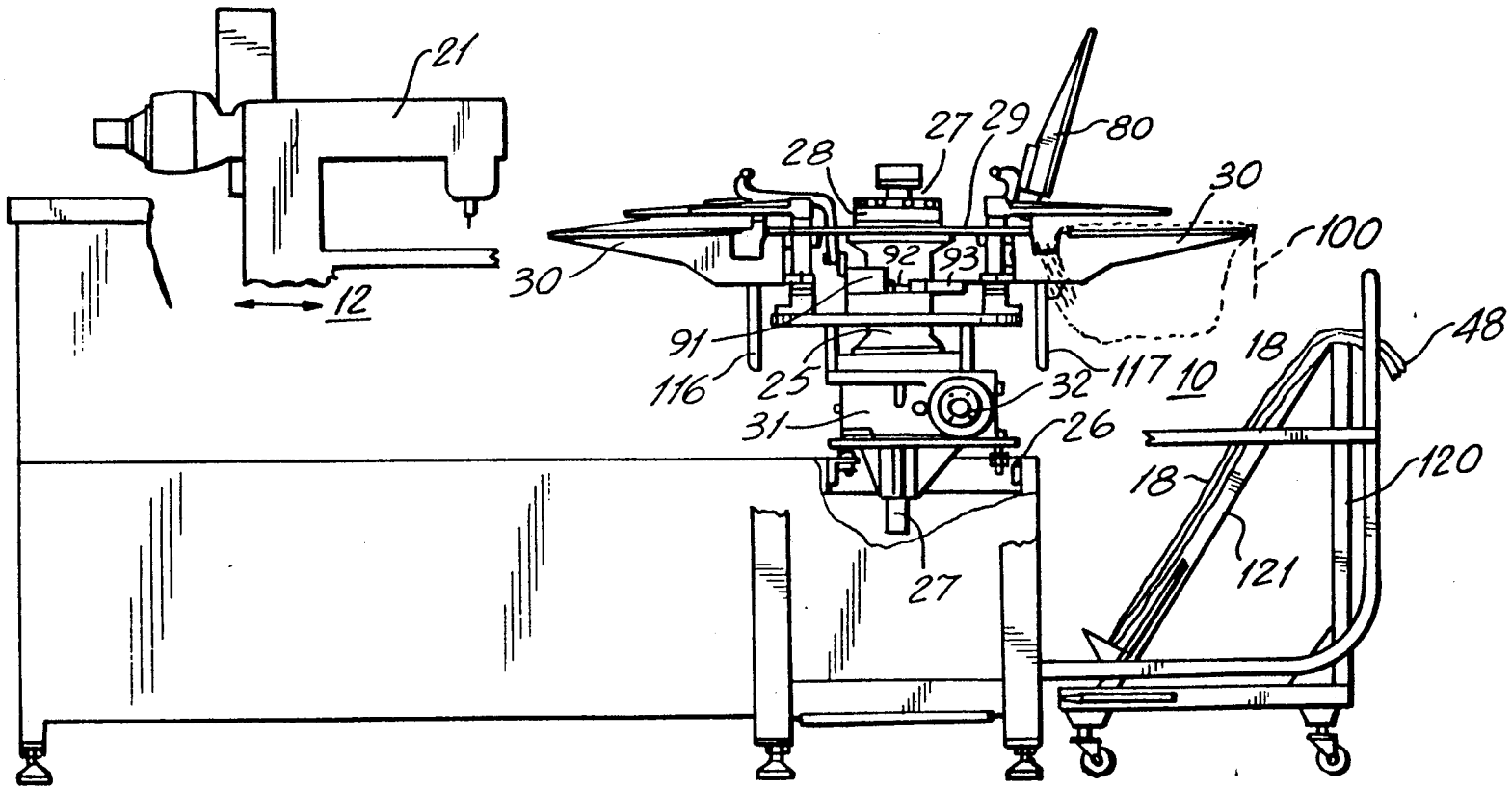
FIG. 3 is a side elevational view of the apparatus of FIG. 1, with parts broken away.
Figure 4:
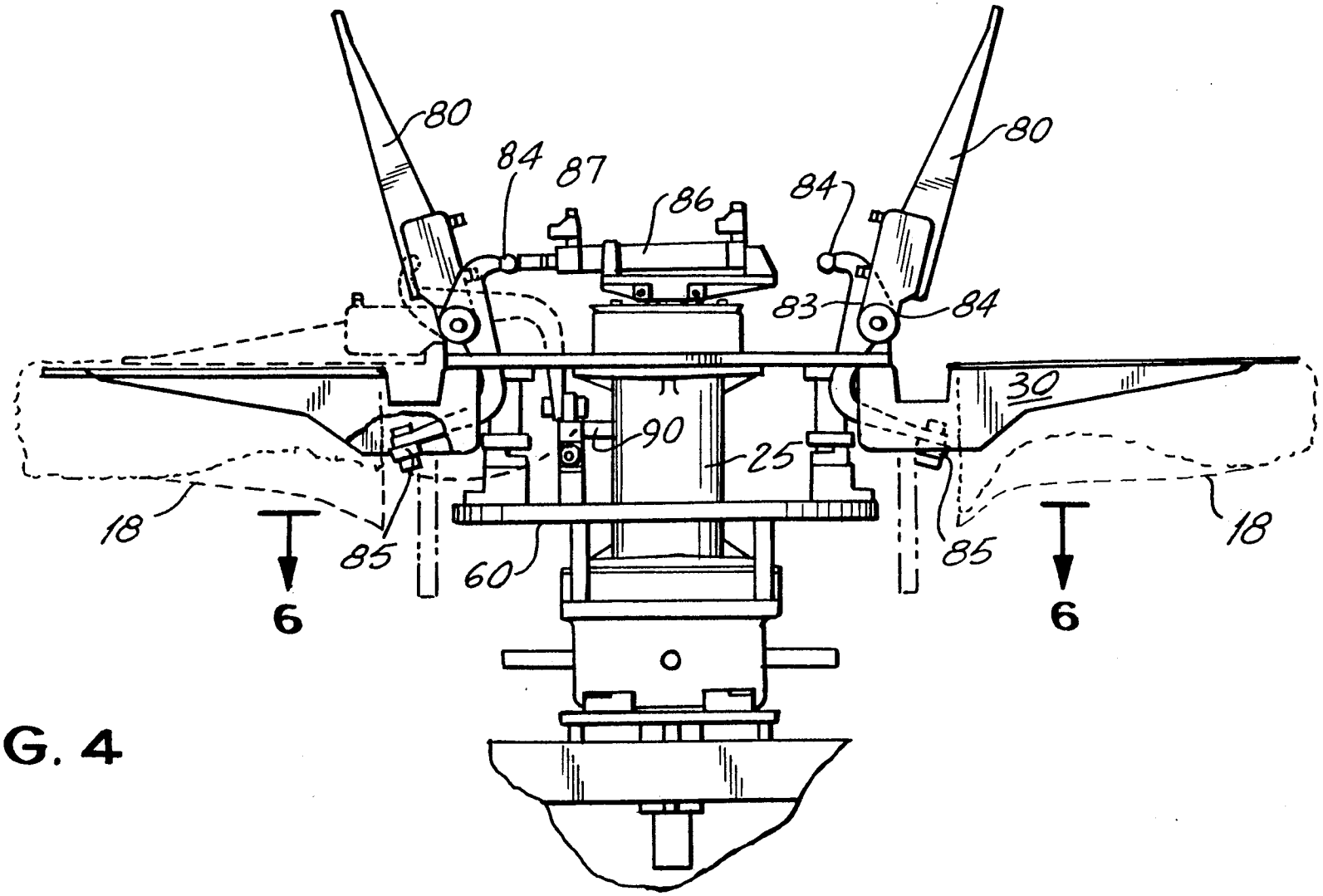
FIG. 4 is an enlarged, fragmentary front elevational view showing the equipment in the relationship of FIG. 2, but illustrating further details of construction.

The turret apparatus of the invention includes a tubular center column structure 25 (FIG. 4) mounted on an indexing drive which in turn is mounted on a rigid, fixed frame structure 26 (FIG. 3). A tubular central stationary, hollow shaft 27 mounted at the base of the structure 26 extends upwardly through the turret column 25 and carries a stationary platform that mounts a cylinder 86 (FIG. 2) designed to close the sewing clamp 80 (FIG. 1) at the activity station 11. The structure 25 supports the horizontally disposed turret table 29 and a safety clutch 28 which links the turret table to the indexing drive. As shown in FIG. 1, the turret table 29 is generally square in configuration and rigidly mounts at each side of its four sides a radially projecting work platform 30. As will appear, all of the work platforms 30, and the mechanisms attendant thereto, are of identical construction. However, as the turret mechanism indexes from one station to the next, different activities will be performed by the mechanisms of the respective platforms. Pursuant to the invention, this is accomplished by providing fixed actuating mechanisms on the central turret structure, which selectively operate the desired mechanisms in the various index positions, after each indexing operation.

To advantage, indexing movements of the turret apparatus are effected by means of an indexer drive box 31 mounted at the base of the pedestal and driven by a worm gear motor 32. Appropriate control means (not shown) are of course provided to precisely control the indexing increments, in the illustrated case to 90°.

Referring to FIG. 1, each work platform is provided with a pocket support mechanism, comprising a pair of support arms 40, 41 mounted on vertical shafts 42, 43 for limited pivoting movement about vertical axes. At their outer ends, the support arms 40, 41 carry horizontal support plates 44, 45, each provided at its top edge with retaining clips, symbolically indicated at 46. For orientation purposes, the "top" edges of the support plates 44, 45 are radially outward with respect to the rotational axis 47 of the turret.

As one of the work platforms 30 is indexed to the load station 10, the support arms 40, 41 and the plates 44, 45 supported thereby are pivoted toward each other, in a manner to form a suitable platform for supporting a pocket ply 19. The operator at the load station retrieves a pocket ply from a suitable adjacent supply (not shown) and places it on the closed-together plates 44, 45, with the top edge of the pocket ply (hemmed at the top in a previous operation) underneath the retaining clips 46. In conjunction therewith, and typically prior thereto, the operator will apply a tubular shirt body over the radially extending platform 30, with the bottom or waist portion 48 of the shirt body being applied first. As shown in FIG. 10, the length of a typical tubular shirt body 18 is substantially greater than the radial dimension of the work platform 30, and the tubular width of the shirt body 18 is likewise substantially greater than the width of the work platform 30. Accordingly, when the tubular shirt body is applied over the work platform 30, the waist portion gathers in folds at the base end of the work platform. Desirably, a trough 33 is provided at the base end of the work platform to accommodate the gathering of fabric in that area. The excess fabric in the width direction simply hangs downward in a loose drape providing clearance space underneath the platform to facilitate a subsequent sewing operation. The operator positions the body over the work platform 30 so that the area to receive the pocket is positioned directly over a pocket sewing gap 50 (FIG. 1) which is formed between plates 51, 52 which together comprise the main surface of the work platform 30.

In the sequence of operations of the illustrated apparatus, the support arms 40, 41 and pocket-receiving plates 44, 45 are brought to their closed positions while indexing from stack station 13 to the load station 10 in order to accommodate the loading operations. After the work platform has been indexed to the fold station 11, and an internal pocket plate has been inserted under the pocket the support arms and plates are pivoted laterally outward to open positions, as reflected in FIG. 1. They remain in open positions as the work platform is indexed successively to the sewing station 12 and later to the stacking station 13. During the next indexing operation, as the work platform moves back to the load station 10, the arms are caused to pivot inward to their closed positions.

Figure 6:
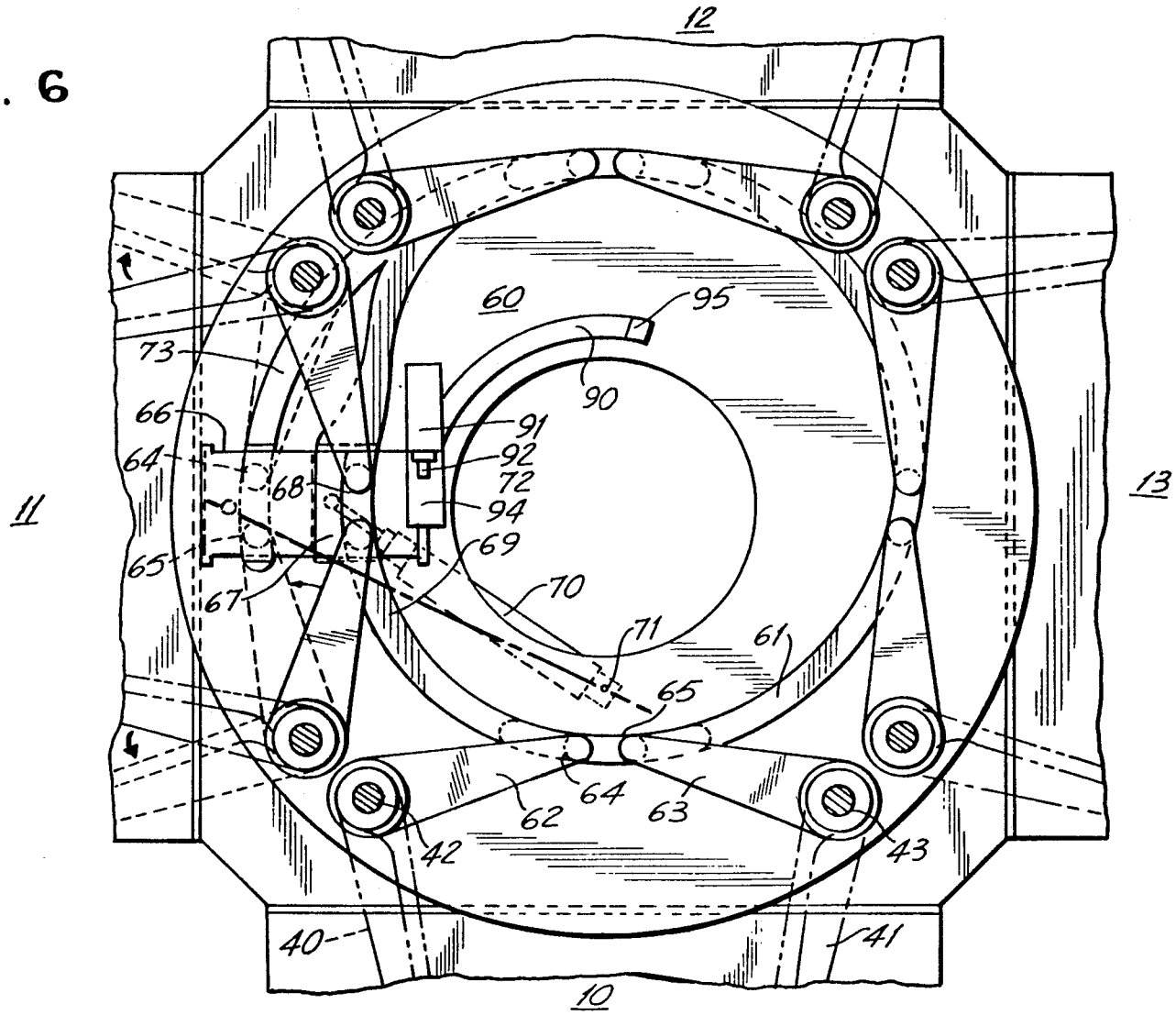
FIG. 6 is an enlarged, fragmentary cross sectional view as taken generally on line 6—6 of FIG. 4.

In accordance with one aspect of the invention, the pivoting action of the support arms 40, 41 is achieved by means of a fixed cam plate 60 mounted directly on the housing of the indexer drive 31 (FIG. 3), below the indexable table 29. The cam plate is provided with a contoured groove 61 and, as shown in FIG. 6, the pairs of support arms 40, 41 and shafts 42, 43 are connected to lever arms 62, 63 carrying cam followers 64, 65 at their outer end, which are received in the cam groove 61. At the load station 10, the position of the groove 61 is such as to swing the levers 62, 63, and the arms 40, 41 connected thereto, inwardly to their closed positions. When the work platform is indexed for the next sequence of operations, the cam followers 64, 65 move therewith, following the groove in the stationary cam. As illustrated in FIG. 6, in the indexing movement from the load station 10 to the folding station 11, the groove 61 remains at a fixed radius, so that the arms 40, 41 are held in their closed positions.

At the folding station, the cam plate 60 is formed with a radial slot 66 which contains and guides a radially movable cam block 67 formed with a short segment 68 of the cam groove. As the cam followers 64, 65 approach the folding position 11, they enter the short groove section 68. At that juncture the groove section 68 is aligned with a segment 69 of the cam groove 61, which lies between the loading and folding stations 10, 11.

A fluid cylinder 70 is mounted at 71 to the underside of the cam plate 60, with the rod end of the actuator being attached at 72 to the slidable cam block 67. Accordingly, when the cam block cylinder 70 is operated, the slidable cam block 67 moves radially outward in its guide slot 66 to an outer limit position, in which the cam groove segment 68 in the block is aligned with a groove segment 73 in the main cam groove 61. As the cam block 67 is moved outward, the lever arms 62, 63 and the attached support arms 40, 41 are pivoted outward to separate the plates 44, 45 in the manner shown at the fold station 11 in FIG. 1. This operation is performed in conjunction with operations of the folding mechanism (to be described), so that the handling of the pocket ply is transferred from the plates 44, 45 to elements of the folding mechanism.

For the next approximately 180° of arc of the cam groove 61, the radius of the groove remains substantially that of the groove segment 73, maintaining the support arms 40, 41 in their spread-apart orientation, as the work platform is indexed from the folding station 11 to the sewing station 12, and from the sewing station to the stacking station 13. This keeps the arms 40, 41 and plates 44, 45 out of the way for the sewing operation. The cam groove 61 thereafter gradually returns to its minimum radius opposite the load station 10, so that a given pair of arms 40, 41 is rotated back to a closed position, as they are indexed back to the load station 10.

Operation of the cam block cylinder 70 is controlled so that, shortly after initiation of an indexing movement, and after cam followers 64, 65 previously at the fold station have moved out of the groove segment 68 of the cam block and into the groove segment 73 of the main cam plate, the cam block 67 is retracted, to bring the cam groove segment 68 back into alignment with the groove segment 69 of the main cam 60, in preparation for receiving a new set of cam followers being indexed from the load position. After the indexing motion has been completed, and the folding mechanisms provided at the fold station 10 have taken control of the pocket ply, the cam block cylinder 70 is actuated, moving the cam block 67 radially outward to separate the support arms and their respective plates 44, 45.

In the apparatus of the invention, each work platform 30 provided with a retractable sewing clamp mounted on the central turret table 29, for upward-downward pivoting movement about a horizontal shaft 81. Spring means 82 are provided to bias the sewing clamps 80 to pivot upward, to a nearly vertical position, as shown in FIG. 2, such that the sewing clamps are always in their upwardly oriented, retracted positions, unless specifically actuated to a horizontal clamping position.

Pursuant to the invention, each of the sewing clamps 80 carries a push lever 83 having a spherical or otherwise suitably shaped push element 84 at its outer end. At its opposite end, which projects below the turret table 29, the push lever 83 carries a cam roller 85. A fluid actuated clamp cylinder 86 is mounted centrally above the turret table 29 by means of a non-rotatable support 27 extending centrally through the center column structure 25 of the turret mechanism. The clamp cylinder 86 has a fitting 87 at the end of its cylinder rod, which forms a socket adapted for cooperation with the spherical push element 84.

When a work position is initially indexed to the folding station, the sewing clamp 80 will be in its upright, retracted position, substantially as shown in FIG. 1, with the spherical push element 84 positioned directly opposite the contoured fitting 87 of the clamp cylinder 86. After certain preliminary operations occur at the folding station 11, namely the transfer of the pocket ply to the folding mechanism, the performance of the hem folding operations, and the retraction of the support arms 40, 41, the clamp cylinder 86 is extended to bring the contoured fitting 87 into contact with the spherical push element 84 and to rotate the sewing clamp 80 downward into clamping contact with the folded pocket ply.

Since the clamp cylinder 86 is fixed in its rotational orientation, and therefore does not move when the turret is indexed, means are provided to retain the sewing clamp in its clamping position after initially being placed in such position by the clamp cylinder 86. For this purpose, there is provided an arcuate cam track 90 (see FIG. 6) which extends from a point slightly beyond the position of the folding station 11 to a point slightly beyond the position of the sewing station 12. Cooperating with the arcuate cam track 90 is a retractable cam block 91, which is attached to the rod 92 of a fluid actuated clamp lock cylinder 93 (FIG. 3).

Prior to actuation of the clamp cylinder 86, the clamp lock cylinder 93 is actuated to extend its operating rod 92 and move the cam block 91 to a forward position, shown in FIG. 6. With the cam block in the forward position, there is a space, indicated by the reference numeral 94 in FIG. 6, through which the cam follower wheel 85 may swing, when the clamp cylinder 86 is actuated. Once the sewing clamp 80 is in its horizontal position, the clamp lock cylinder 93 is retracted, along with the cam block 91, bringing the cam block into a position directly underlying and supporting the cam follower wheel 85 (see FIG. 8). The clamp cylinder 86 can then be retracted, and the sewing clamp will nevertheless remain closed by the cooperative action of the cam follower wheel 85 and the cam block 91.

During the next indexing movement of the apparatus, the sewing clamp 80, closed at the folding station 11, is held closed as the particular work platform moves into the sewing station, because the cam follower 85 continues to be supported by the arcuate cam rail 90. After the sewing operation has been completed, and a further indexing of the turret ensues, the cam follower wheel 85 is permitted to roll down an inclined surface 95 at the terminal end of the cam rail 90, allowing the sewing clamp to be lifted by the action of its return springs 82 to its normal, retracted position.

As previously described, the tubular width of the shirt body 18 typically is significantly greater than the width of the work platform 30, allowing the extra fabric of the tubular piece to drape loosely down below the platform (see FIG. 3 for example). This facilitates the sewing operations at the sewing station 12 by providing access for the base of the sewing machine to easily enter the open fabric tube. In addition, a shoulder portion 100 (FIG. 3) of the fabric piece typically hangs loosely downward a few inches over the front edge of the work platform. As the last operation of the turret system, the shirt body is removed from its work platform and placed on an adjacent rack, designated generally by the numeral 22. The stacking facility, to be described later, includes a gripper device 101, schematically represented in FIG. 5, vertically movable on a carriage 102 and having pivoted gripping jaws 103. When a completed part reaches the stacking station 13, the gripper is actuated to its upper position, where it grips the dangling shoulder portion 100 of the shirt body. The gripper is then actuated in the downward direction, partially extracting the shirt body from its work platform 30. While thus gripped and partially withdrawn, the shirt body is engaged by a stacker mechanism to be further described, which functions to withdraw the balance of the shirt body from the work platform and to place the body in a draped, flat condition on a stacker cross beam 104.

Figure 9:
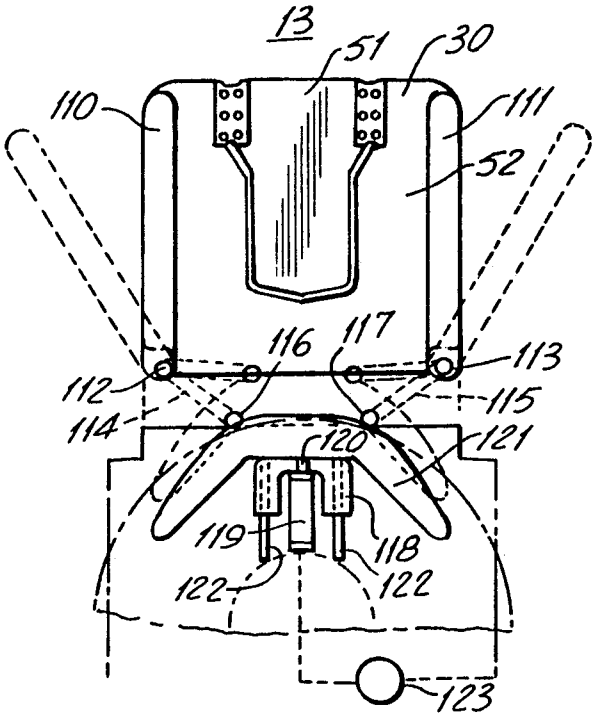
FIG. 9 is a fragmentary schematic representation of an actuating mechanism employed in the apparatus of the invention at the stacking station, for converting a loosely draped tubular body to generally flat form for stacking.

The stacking operation is optimized by having the tubular shirt body in a flat, generally full-width condition, rather than in the loosely draped form in which the shirt body arrives when it is indexed to the stacking station 13. To this end, each work platform 30 is provided along its opposite side edges with spreader plates 110, 111 (FIG. 9) pivoted at 112, 113 at the back of the work platform. During the initial processing, the spreader plates are retracted to positions within the normal lateral confines of the work platforms 30, with suitable spring means (not shown) being provided for this purpose.

On the underside of the work platform, the spreader plate shafts 112, 113 are connected to lever arms 114, 115 from which actuating rods 116, 117 extend downwardly.

A generally U-shaped slide 118 is mounted to the underside of the fixed control cam plate 60 in the region opposite the stacking station. The bracket 118 carries a spreader cylinder 119, the operating rod 120 of which is attached to a movable cam plate 121. Spaced guide rods 122, fixed to the movable cam plate 121, are guided in the U-shaped slide 118 for generally radial movement from a retracted position, shown in full lines in FIG. 9, to an extended position, shown in broken lines in the same figure.

When a work platform arrives at the stacking station 13, the gripper clamps the flap 100 and pulls it down to a predetermined level. During the early stage of the removal of the finished article, the spreading cylinder 119 is actuated, urging the cam plate 121 radially outward against the downwardly extending rods 116, 117. Continued outward movement of the cam plate 121 causes the two spreader plates 110, 111 to pivot outwardly, spreading the tubular shirt body laterally into substantially flat, tubular form. To avoid overstressing of fabric during this operation, it is desirable to adjustably control the fluid pressure applied to the cylinder 119, by means such as a pressure regulator 123. This can be set such that, when the spreader plates 110, 111 meet a predetermined resistance to outward motion, the fluid pressure on the cylinder is balanced against the resistance of the fabric. As the thus-spread and flattened fabric is drawn off of the work platform at the stacking station, it is received by the stacker elements in its flat, fully spread form for optimum stacking efficiency. The maximum stroke of the plates 110 and 111 is slightly greater than the maximum width of the widest shirt body. This design eliminates the necessity for the size adjustment of this mechanism when processing different size shirt bodies.

The specifics of the external equipment provided at the various activity stations are not critical. Desirably, at the load station, the machine operator is provided with a cart 120 (FIG. 3) having a slanted front face 121, over which a batch of shirt bodies are draped, desirably with their waist portions 48 at the front for easy gripping by the operator. A rack of pocket plies (not shown) can also be mounted on the cart 120.

At the fold station 11, the folding apparatus provided can be of any useful type, of which several are known in the art. U.S. Pat. No. 4,445,631, for example, illustrates one form of pocket folding device. Within the contemplations of the present invention, the folding apparatus includes a flat, elongated, pocket-shaped folding plate 130 which is arranged, when a loaded pocket ply is indexed into the folding station, 10 to be projected radially inward closely underneath the still closed pocket holding plates 44, 45. A clamp (not shown) is actuated for gripping and transferring the pocket ply to the folding plate. As soon as that occurs, the supporting plates 44, 45 are swung outwardly to their retracted positions, enabling a hem folding mechanism 131 (FIG. 2) to be pivoted downward about its horizontal mounting shaft 132 to a position directly overlying the pocket ply, now supported only by the projected plate 130. The folding mechanisms, in itself of known construction, includes a plurality of pivoted folding blades symbolically indicated at 133, 134 in FIG. 1, arranged to swing under the projected plate 130 and to fold the overhanging margins of the pocket ply underneath the plate 130 to form hem folds on the side and bottom edges. The plate 130 and folding mechanism 131 are then lowered onto the underlying shirt front, after which the folding blades 133, 134 are pivoted out from underneath the plate 130 and the entire folding mechanism 131 is retracted upwardly.

Upon completion of this hem folding operation, the sewing clamp 80 at the folding station is actuated, by means of the clamp cylinder 86, as previously described, which presses the hem folded pocket part firmly downward against the shirt body underneath. Immediately thereafter, the projected folding plate 130 is retracted out of the way, leaving the hem-folded pocket part pressed against the shirt body, ready for sewing.

The equipment at the sewing station is basically conventional, having a programmed sewing path coincident with the slots provided in the work platforms 30 and in the sewing clamps 80.

Figure 8:
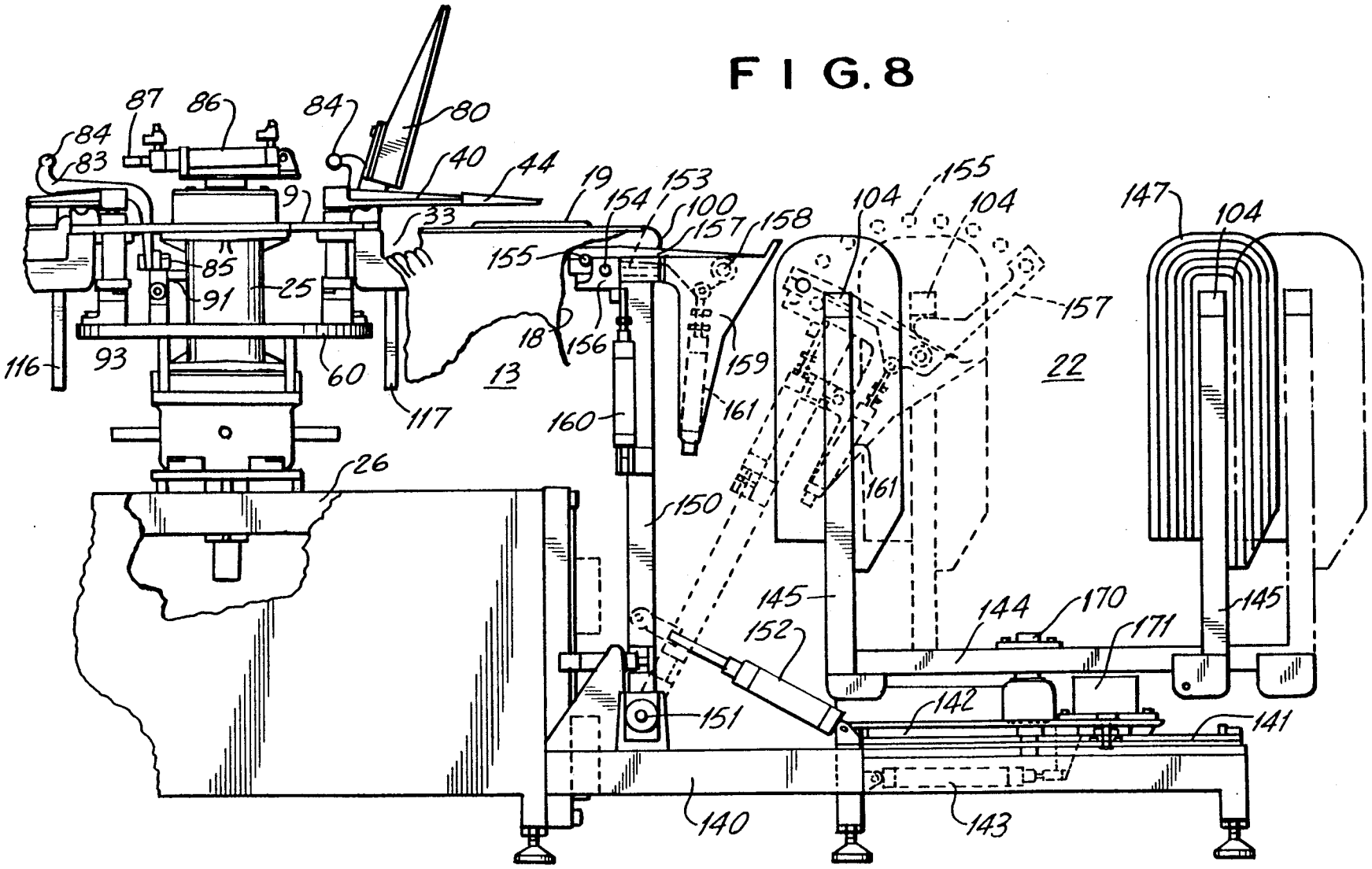
FIG. 8 is a fragmentary front elevational view of the apparatus of FIG. 1, showing further details of a stacker apparatus employed therewith.

The stacking apparatus, located at the stacking station 13, is illustrated best in FIGS. 2, 7 and 8. A supporting frame 140 is attached to the main machine foundation structure 26 and mounts a pair of spaced tracks 141 on which is mounted a carriage 142, arranged for limited movement on the rails toward and away from the turret axis, by means of a fluid cylinder 143. The carriage 142 rotatably supports a central beam 144 carrying a vertical post 145 at each end. Horizontal stacker beams 104 are mounted at the tops of the vertical posts and are arranged to receive finished shirt bodies in draped, layered fashion, as reflected at 147 in FIG. 8.

At one side of the stacker frame 140 is a rocker arm 150, which is pivoted at 151 and movable between upright (solid lines) and outwardly titled (broken lines) positions by means of a rocker cylinder 152.

At its upper end, the rocker arm 150 pivotally mounts, on a horizontal shaft 153 first and second flip rods 154, 155 mounted in cantilever fashion adjacent the rocker arm 150. The outermost flip rod 154 is mounted rigidly on a support 156 pivoted on the shaft 153. The second flip rod 155 is mounted parallel to the rod 154 and is normally adjacent thereto. It is, however, mounted on a flip arm 157 pivoted at 158 in a bracket 159 which is fixed to the support 156 and rotatable therewith about the axis of the shaft 153. A tilt cylinder 160 is mounted on the rocker arm 150 and is connected to the support 156 for rotating the same between a working position, shown in full lines in FIG. 7, and a retracted position, shown in broken lines in the same figure, in which the flip rods are tilted downwardly almost to a vertical position.

As a finished shirt body is indexed to the stacking position 13, flip rods are in a nearly vertical position as shown in FIG. 7. This allows the draped shirt body to be brought into the stacking position without interference from the flip rods. At the same time the fluid cylinder is momentarily actuated to move the stacker beam 104 and its supporting post 145 out of the way (to the broken line position shown in FIG. 8) to accommodate the indexing operation.

Figure 5:
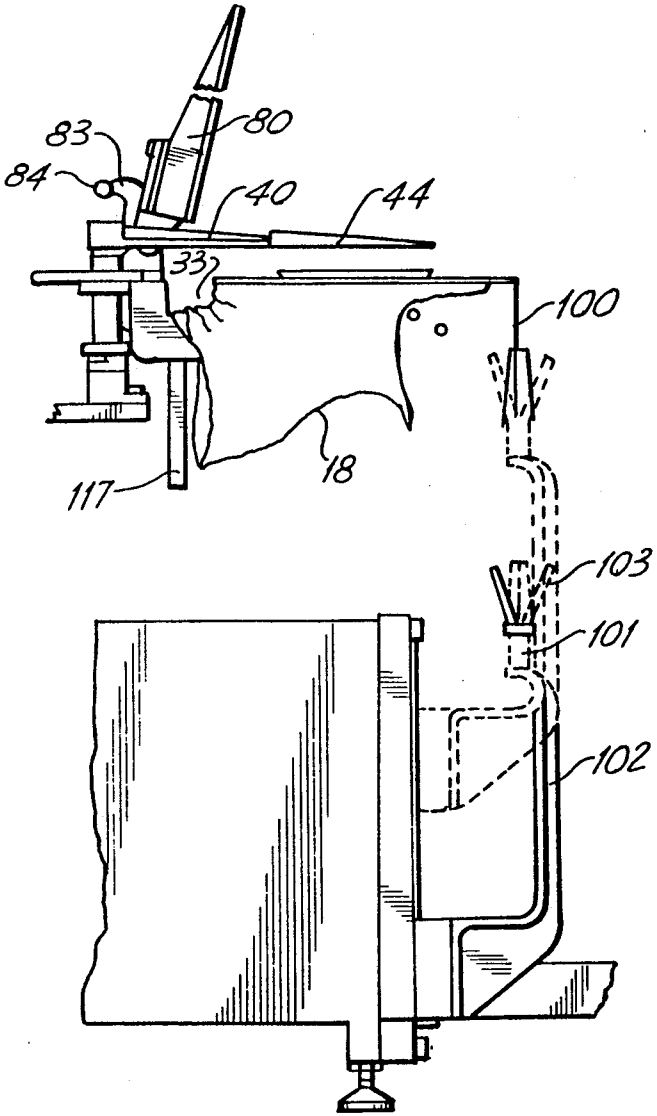
FIG. 5 is a fragmentary side elevational view showing portions of the apparatus at the stacking station.

Approximately half way through the index, the gripper mechanism, shown in FIG. 5, is actuated to start its upward movement to engage the dangling shoulder portion 100 of the shirt body and draw the shirt body downwardly, partly off of its work platform. As soon as the index operation has been completed, the tilt cylinder 160 is retracted, lifting the flip rods 154, 155 to their horizontal positions shown in full lines in FIG. 7. When the gripper mechanism has retracted fully, or at least partially, the rocker cylinder 152 is retracted, to move the rocker arm forward to the position shown in dotted lines in FIG. 8. The first flip rod 154 engages the fabric, just below the front edge of the work platform 30 and continues to move outwardly. Since the shoulder portion of the shirt body is engaged by the gripper, the continued outward movement of the flip rod 154 causes the shirt body to be drawn outwardly off of the work platform.

By the time the first flip rod 154 reaches its limit position, either against the cross beam 104, or against the accumulating stack of shirt bodies already laid over the beam, the shirt body is mostly (but usually not completely) withdrawn from the work platform. At this juncture, a flip cylinder 161 is actuated, pivoting the flip arm 157 through a substantial arc (e.g. typically, greater than 90°) causing the second flip rod 155 to move through an arcuate path upwardly and rearwardly, as shown in sequential dotted line images in FIG. 8. The arcuate path of the flip rod 155 is such that the trailing end of the shirt body is flipped up and over the top of the stacker beam 104 and falls by gravity down along the back side of the beam 104. During the actuation of the flip arm 157, the front part of the fabric is held immobilized by pressure of the first flip rod 154. As soon as the final flipping operation has been completed, the various cylinders 152, 160, 161 are actuated in the opposite directions, returning the flip arm 157 to its normal position, returning the rocker arm 150 to its upright position and returning the flip rods 154, 155 to their retracted, near-vertical positions, all in readiness for the next operation.

When one of the stacker beams 104 is adequately filled with product, the rotary stacker carriage 144 is to be rotated about a central supporting shaft 170, moving the filled stacker beam 104 to the outside, and bringing an empty beam into position for further operations. Rotary indexing of the beam 144 may be accomplished by a motor 171.

Throughout the stacking operation, the spreader plates 110, 111 (FIG. 9) remain actuated, so that the tubular shirt bodies are in a flat, full-width configuration as they are laid on to the stacker beam.

The system of the invention enables a high degree of automation to be imparted to the process of setting pockets on tubular shirt bodies, using equipment which is both economical in design and, perhaps equally important, economical of factory floor space.

Pursuant to the invention, a simplified arrangement is provided enabling tubular shirt bodies to be applied over radially projecting, indexed work platforms, bottom side in, which greatly facilitates the processing operations.

One feature of the invention is the highly simplified turret mechanism, which is enabled by the fact that all of the actuating devices are mounted on the non-rotating central structure of the turret apparatus. Although each of the indexable work positions carries with it movable support arms for holding pocket plies, a movable sewing clamp for engaging the folded ply and holding it during the sewing operation, and spreader plates for converting the loosely draped tubular body to flat tubular form for stacking, the actuating mechanisms for all of these devices are mounted in fixed locations on the central structure. As individual work positions are indexed about the turret, they successively come into positions at which the necessary actuator devices have been placed.

It should be understood, of course, that the specific form of the invention herein specifically described is intended to be representative only, as certain changes may be made therein without departing from the clear teachings of the disclosure. Accordingly, reference should be made to the following appended claims in determining the full scope of the invention.

I claim:

1. A process for setting pockets on tubular shirt bodies, which comprises (a) providing an indexable turret structure having a plurality of radially projecting work platforms indexable into successive activity positions, (b) at a load station, applying a tubular shirt body endwise and in a loosely draped manner over the outer end of one work platform, (c) supporting a pocket ply spaced above the region of said shirt body to which a pocket is to be placed, (d) at a folding station, forming hem folds on said pocket ply by under folding the side and bottom edge margins of said ply and clamping said folded ply to the front of said shirt body, (d) at a sewing station, sewing the hem-folded pocket ply to the front of said shirt body, (e) at a stacking station, internally spreading said tubular shirt body to generally flat, full width configuration and removing said shirt body to an adjacent stack.

2. A process according to claim 1, further characterized by (a) at said folding station, projecting a pocket forming blade radially inward underneath said pocket ply and folding said edge margins under said forming blade, (b) placing and clamping said blade and said folded ply on said shirt body, and (c) thereafter radially retracting said forming blade to enable indexing of said turret structure.

3. A process according to claim 1, further characterized by (a) the radial length of each of said work platforms being substantially less than the length of said shirt body, and (b) at said load station, placing said shirt body waist end first over said one work platform, with an upper portion of said shirt body hanging over the outer end of the platform and the waist portion of said shirt body being gathered at the inner end area of said one work platform.

4. A process according to claim 3, further characterized by (a) at said stacking station, gripping said shirt body by the over hanging upper portion thereof and partially withdrawing said shirt body from another work platform, and (b) engaging an intermediate portion of said shirt body between the gripped upper portion thereof and the outer end of said another work platform and moving said intermediate portion radially outward with respect to said another work platform to fully withdraw said shirt body from said another work platform.

5. A pocket setter apparatus for tubular shirt bodies and the like, which comprises, (a) a central turret pedestal, (b) an indexable work platform supported on said pedestal for incremental rotation, (c) said indexable work platform having a plurality of uniformly spaced radially disposed work platforms thereon, (d) said work platforms being sufficiently unobstructed at their outer ends to enable a tubular shirt body to be applied thereover in a loosely draped condition, (e) each work platform having associated therewith a pair of laterally movable support panels movable to a load position for supporting a pocket ply above said each work platform and movable to a retracted position enabling said pocket ply to be placed on a shirt body supported on said each work platform, (f) said apparatus including, arrayed in angular succession about said central turret pedestal radially outward of said work support, a load station where shirt bodies and pocket plies are loaded onto a work platform, a pocket folding station where a pocket ply carried by a work platform is hem-folded for sewing, a sewing station where the hem-folded pocket ply is sewn to the shirt front, and a stacking station where the shirt body and the sewn pocket are removed from a work platform supporting them, (g) each work platform further including a vertically movable pocket clamp operative when actuated to press and hold a folded pocket ply in position before and during sewing, (h) non-indexing actuator means mounted on said central turret pedestal and operative with said support panels and said pocket clamps in selected index positions of said work platforms to effect temporary operation thereof from first positions to second positions, and (i) means independent of said non-indexing actuator means and operative when said support panels or said pocket clamps are actuated from a first position to a second position to cause said support panels or said pocket clamps to be retained in said second position during predetermined subsequent rotary movement of said indexable work platform.

6. A pocket setter apparatus according to claim 5, further characterized by (a) said non-indexing actuator means including fixed control cam means cooperable with said support panels during indexing movements thereof and guiding and controlling the position of said support panels throughout a full indexing cycle, (b) said cam means including a movable cam block associated with the position of said folding station and cooperable with said support panels when located at said folding station, (c) cam block actuator means for moving said cam block to separate said support panels located at said folding station, (d) said cam means being operative to retain said support panels in separated relation throughout at least indexing movement from said folding station to said sewing station.

7. A pocket setter apparatus according to claim 5, further characterized by (a) said pocket clamp comprising a clamp member mounted for pivotal movement about a horizontal axis near the inner portions of said work station and extending generally radially outward from said axis, (b) means biasing said clamp member for upward pivoting movement away from a top surface of said work platform, (c) said non-indexing actuator means including a fluid operated clamp cylinder operative to pivot said clamp member to a horizontal clamping position, (d) cam means for retaining said clamp member in clamping position including a cam follower carried by said clamp member and an arcuate cam element engageable with said cam follower at least during indexing movements from said folding station to said sewing station, and (e) a movable cam segment associated with said arcuate cam element, (e) said movable cam segment being displaceable to a retracted position during pivoting of said clamp member to clamping position and being displaceable thereafter to an operative position for locking said clamp member in said clamping position.

8. A pocket setter apparatus according to claim 7, further characterized by (a) said clamp cylinder being mounted adjacent said work platforms, (b) said clamp member carrying an actuator-engageable element on a portion thereof spaced from said horizontal axis, (c) said clamp cylinder having a movable element engageable with the actuator-engageable element of a clamp member indexed to said folding station for urging said clamp member to a closed position.

9. A pocket setter apparatus according to claim 5, further characterized by (a) each work platform further including spreader elements at each side thereof, (b) said spreader elements being biased to retracted positions allowing a tubular shirt body to remain loosely draped over the work platform, (c) non-indexing spreader actuator means carried by said central turret pedestal and operative when a work platform is located at said stacking station to urge said spreader elements to a spread-apart position for spreading said tubular shirt body to a generally flat full-width condition.

10. A pocket setter apparatus according to claim 9, further characterized by (a) said spreader actuator means comprising a fluid operated spreader cylinder, (b) means including a pressure regulator for supplying fluid to said spreader cylinder, whereby the spreading force applied to said shirt body is limited by the pressure of fluid applied to said spreader cylinder.

11. A pocket setter apparatus according to claim 10, further characterized by (a) said spreader elements comprise spreader plates at each side of a work platform, (b) said plates being mounted for pivoting movement about vertical axes located adjacent the radially inner portions of said work platform and extending outward toward the radially outer portions of said work platform.

12. A pocket setter apparatus according to claim 11, further characterized by (a) said spreader actuator comprising a spreader cam member guided for radial movement and movable by said spreader cylinder, (b) said spreader cam member being mounted below said work platform and adjacent said fixed control cam means, (c) operating elements associated with said spreader plates and cooperating with said spreader cam member for actuating said spreader plates in response to movement of said spreader cam member.

13. A pocket setter apparatus according to claim 9, further characterized by (a) a portion of said shirt body overhanging the outer end of a work platform, (b) gripper means located at the stacking station and operative to engage, grip and draw downward the overhanging portion of said shirt body, and (c) stacker elements operative when said shirt body is engaged by said gripper means and while said spreader elements are separated to engage said shirt body adjacent said work platform and draw said shirt body off of said work platform.

14. A pocket setter apparatus according to claim 13, further characterized by (a) said stacker elements comprising first and second flip rods, (b) said first flip rod being movable in a first stage of operation in a radially outward direction relative to said work platform to draw said shirt body at least partly off of said work platform and into engagement with a stacker beam, and (c) said second flip rod being movable with said first flip rod in said first stage of operation and being separately movable in a second stage of operation in an arcuate path upwardly and outwardly over said stacker beam to cause said shirt body to be draped over said stacker beam.

15. A process for setting pockets on tubular shirt bodies, which comprises (a) providing an indexable turret structure having a plurality of cantilever mounted work platforms indexable into successive activity positions including at least a load station and a sewing station, (b) at a load station, applying a tubular shirt body, endwise and waist end first, in a loosely draped manner over an outer end of a work platform, (c) supporting a pocket ply spaced above a supported region of said shirt body on which a pocket is to be placed, (d) forming hem folds on said pocket ply by under folding side and bottom edge margins of said ply, and clamping said folded ply to the supported region of said shirt body, (e) at a sewing station, sewing the hem-folded pocket ply to the front of said shirt body, and (f) removing said shirt body endwise from its work platform to an adjacent stack.

16. A process according to claim 15, further characterized by (a) the radial length of each of said work platforms being substantially less than the length of said shirt body, and (b) at said load station, placing said shirt body over one work platform, with an upper portion of said shirt body hanging over the outer end of said one platform, the waist portion of said shirt body being gathered at the inner end area of said one platform, and the surface portion of said shirt body to receive said pocket being supported on said one work platform.

17. A process according to claim 15, further characterized by (a) said folded pocket ply being clamped to said shirt body while said shirt body is in said load station.

18. A pocket setter apparatus for tubular shirt bodies and the like, which comprises, (a) a central turret pedestal, (b) an indexable work support mounted on said pedestal for incremental rotation, (c) said indexable work support having a plurality of uniformly spaced cantilever mounted work platforms thereon, (d) said work platforms being sufficiently unobstructed at their outer ends to enable a tubular shirt body to be applied thereover, waist end first, in a loosely draped condition, (e) said apparatus including, arranged in angularly spaced relation about said central turret pedestal, a load station where shirt bodies are loaded onto a work platform, and a sewing station where a hem-folded pocket ply is sewn to the shirt front, (f) said apparatus further including a movable pocket clamp operative when actuated to press and hold a folded pocket ply in position for and during sewing.

19. A pocket setter apparatus according to claim 18, further characterized by (a) each work platform having a pocket clamp mounted thereon and movable therewith.

* * * * *